US005079814A

United States Patent [19]

Moore et al.

[11] Patent Number: 5,079,814

[45] Date of Patent: Jan. 14, 1992

[54] METHOD OF MANUFACTURING A HOLLOW POINT BULLET

[75] Inventors: Steven R. Moore; David A. Imthurn; Brett Olin, all of Lewiston, Id.

[73] Assignee: Blount, Inc., Lewiston, Id.

[21] Appl. No.: 613,281

[22] Filed: Nov. 13, 1990

[51] Int. Cl.[5] ..... B21K 21/06

[52] U.S. Cl. ..... 29/1.23; 29/1.21; 29/1.22; 102/509

[58] Field of Search ..... 29/1.2, 1.21, 1.22, 29/1.23; 72/47; 102/507, 508, 509, 510

[56] References Cited

U.S. PATENT DOCUMENTS

| | | | |
|---|---|---|---|
| 219,840 | 9/1879 | Winchester . | |
| 3,76,302 | 1/1887 | Gregg . | |
| 1,080,974 | 12/1913 | Johnson . | |
| 1,633,168 | 6/1927 | Dickerman . | |
| 1,681,295 | 8/1928 | Johnson . | |
| 1,715,788 | 6/1929 | Rousseau . | |
| 1,730,871 | 10/1929 | Aronson . | |
| 2,838,000 | 6/1958 | Schreiber | 102/92.5 |
| 3,165,809 | 1/1965 | Burns, Jr. et al. | 29/1.23 |
| 3,311,962 | 4/1967 | Burns, Jr. | 29/1.23 |
| 3,349,711 | 10/1967 | Darigo et al. | 102/91 |
| 3,431,612 | 3/1969 | Darigo et al. | 29/1.23 |
| 3,881,421 | 5/1975 | Burczynski | 102/92.2 |
| 4,193,348 | 3/1980 | Halverson | 102/91.6 |
| 4,387,492 | 6/1983 | Inman | 29/1.23 |
| 4,882,822 | 11/1989 | Burczynski | 29/1.22 |

*Primary Examiner*—Joseph M. Gorski
*Assistant Examiner*—Peter Dungba Vo
*Attorney, Agent, or Firm*—Klarquist, Sparkman, Campbell, Leigh & Whinston

[57] ABSTRACT

A method of manufacturing a hollow point bullet and the product resulting therefrom. A core is first formed from a deformable first metal and the entire core is electroplated with a second metal. A partially electroplated cavity is then formed within one end of the core with slits through the second metal along the cavity walls. The core is formed into its final shape in such a manner that the walls of the cavity are inclined at a desired angle relative to the axis core and the slits are extended to the circumferential edge of the cavity.

10 Claims, 2 Drawing Sheets

METHOD OF MANUFACTURING A HOLLOW POINT BULLET

This invention relates generally to hollow point bullets and, more particularly, to a method of manufacturing a hollow point bullet and the bullet arising from the method.

Hollow point bullets are designed to expand or "mushroom" upon impact with a target to prevent the bullet from passing through the target and thereby cause the bullet to fully transfer its kinetic energy to the target. Various types of hollow point bullets have been known for years and each generally includes a lead core in one end of whichs is formed a cavity. Upon impact with a target, the portion of the core defining the cavity folds back to form a mushroom shape that prevents the bullet from undesirable target penetration and increases wound channel diameter.

Hollow point bullets generally have a metal jacket surrounding a soft lead core to insure proper feeding of the bullet into the firing chamber of a gun. These jackets may be a separately formed jacket into which the lead core is placed or a jacket electroplated onto the lead core.

Attempts at promoting mushrooming of a hollow point bullet have generally involved scoring, slitting or otherwise weakening the separately formed jacket in the area of the bullet nose. Bullets of this design have not proved entirely satisfactory because the weakened jacket does not remain fixed to the lead core. With the jacket potentially breaking free of the core, the degree of expansion and depth of penetration become unpredictable. One solution taught in U.S. Pat. No. 4,193,348 avoids slits entirely in the jacket, but this tends to inhibit the desired mushrooming.

Another approach taught in U.S. Pat. No. 3,431,612 is to slit the interior of the core prior to electroplating a jacket onto the core. An electroplated jacket is more firmly attached to a lead core than a separately formed jacket. The slits cause cleavage of the electroplated metal when the jacket is plated onto the core. These cleavages weaken the jacket at these points, but are insufficient to promote the desired mushrooming. To insure the bullet mushrooms upon impact, additional slits are often made to the outside of the jacket. These exterior slits, however, tend to promote fragmentation of the bullet, and bullets employing them require a consistent impact velocity to reliably function.

The present invention overcomes the drawbacks of prior hollow point bullets by utilizing an arrangement of slits through the jacket which promote the desired mushrooming without causing fragmentation.

SUMMARY OF THE INVENTION

An object of the invention, therefore, is to provide a method of manufacturing an improved hollow point bullet.

Another object of the invention is to provide a jacketed hollow point bullet that mushrooms in a predictable, desirable way without fragmentation.

In accordance with these objects, a method of manufacturing a hollow point bullet comprises the steps of electroplating a core of a deformable first metal such as lead with a harder second metal such as copper, and creating a cavity partially electroplated within one end of the core with slits through the second metal along the cavity walls. In the preferred embodiment, the cavity is created by pressing a tapered tip into the electroplated core for splitting apart the second metal to define the slits. As a final step, the method includes inclining the walls of the cavity to a desired angle relative to the core axis to produce the desired mushrooming and simultaneously forming the ogive on the exterior of the one end of the bullet.

A hollow point bullet manufactured according to the invention thus includes an electroplated core comprising a deformable first metal and a second metal electroplated onto the first metal. Defined within the nose of the core is a partially electroplated cavity. Within the cavity the electroplated second metal is split into separate segments plated to the first metal on walls of the cavity. The segments define slits through the second metal along the cavity walls. The walls of the cavity are angled relative to the core axis to cause the walls to fold outward upon impact of the bullet against a target. The core thus splits upon impact along the slits defined within the cavity, but it does not fragment because of the bonding of the electroplated metal segments to the deformable metal.

The foregoing and other objects, features, and advantages of the invention will become more apparent from the following detailed description of a preferred embodiment which proceeds with reference to the accompanying drawings.

DESCRIPTION OF A PREFERRED EMBODIMENT

Figure 1:
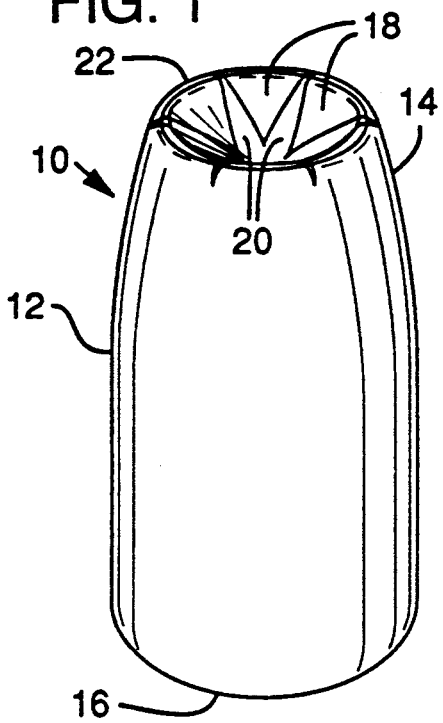
FIG. 1 is perspective view of a hollow point bullet constructed according to the invention.

Referring to FIG. 1, there is shown a bullet 10 manufactured according to the invention. The bullet has a generally cylindrical main body 12, a first end in the form of a nose 14 and a generally flat second end 16. The core of the bullet is a deformable metal such as lead which is electroplated with a jacketing material such as copper.

Defined within the nose 14 is a partially electroplated cavity. Within the cavity, the jacketing material is split into triangular segments 18 which define slits 20 through the material along the cavity walls. These slits 20 extend from the circumferential edge 22 of the cavity toward the cavity bottom. It has been determined through repeated testing of the bullet that its mushrooming characteristics are best if the slits 20 are six in number and are spaced equidistantly apart along edge 22. To further promote the desired mushrooming, the walls of the cavity are inclined to a desired angle relative to the longitudinal axis of the core. This incline causes the walls to fold outward from the axis upon impact of the bullet against a target.

Figure 4A:
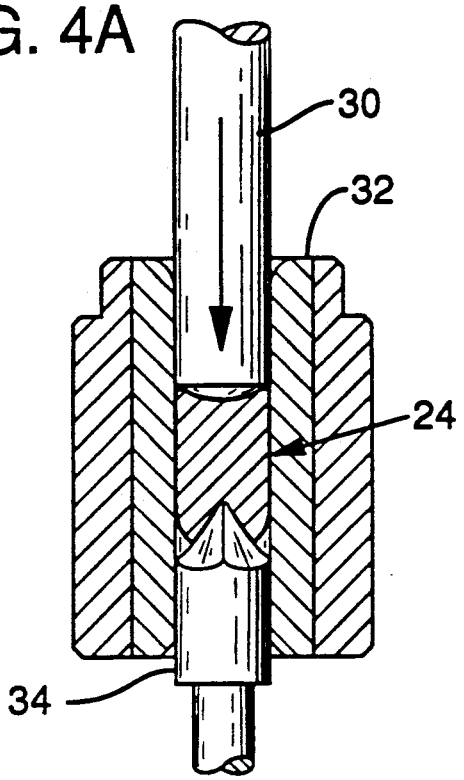
FIGS. 4A–B illustrate preferred methods for carrying out the last two steps of manufacture.
Figure 4B:
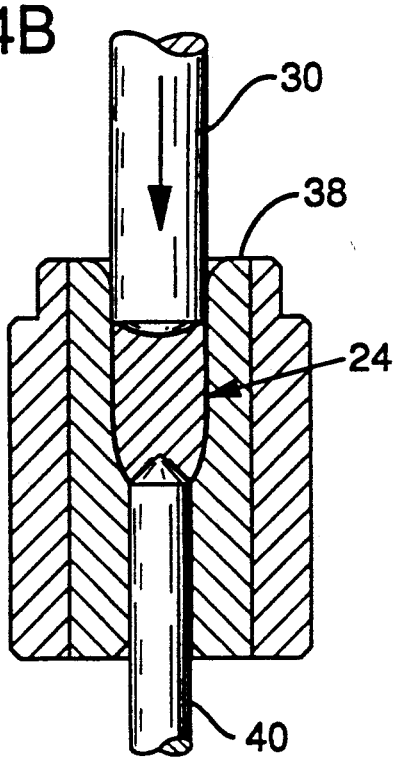
Figure 5:
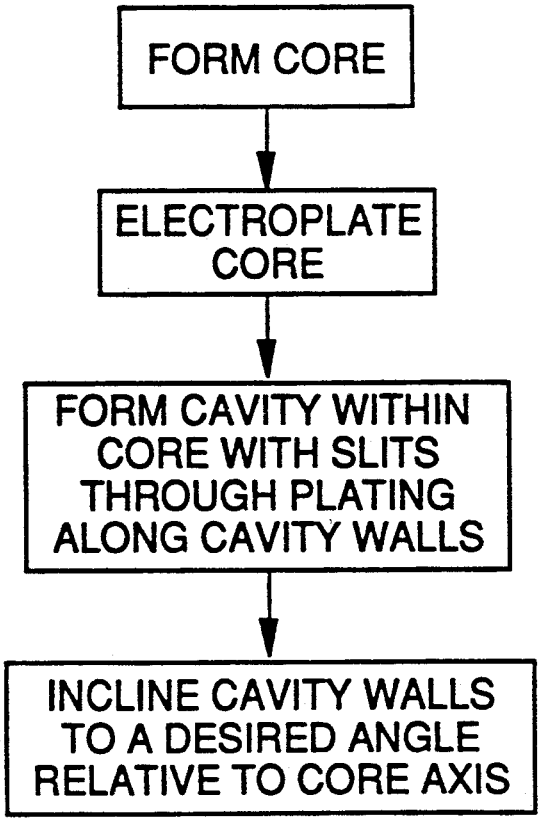
FIG. 5 is a flow diagram illustrating the steps of manufacture shown in FIGS. 2A–D.

The progressive steps for manufacturing the bullet of FIG. 1 are illustrated and described in FIGS. 2–5. Referring to FIGS. 2A and 5, a preselected quantity of a deformable first metal 23 such as lead is initially extruded into a cylindrical core form and sheared to a preselected length. One end of the core is then preferably swaged in a conventional manne into a core 24. This swaging provides a domed or rounded end 26 on the core, which ultimately becomes the nose 14 of the bullet 10. It is possible to manufacture a bullet according to the invention with a flat 26 end instead of rounded end 26 at this step, but proceeding with the rounded end is preferable.

Figure 2A:
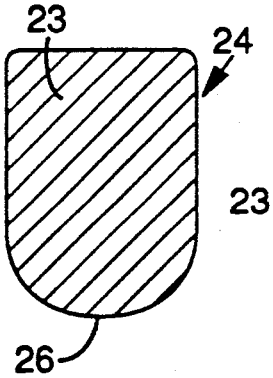
FIGS. 2A–D illustrate progressive steps of manufacturing a bullet according to the invention.
Figure 2B:
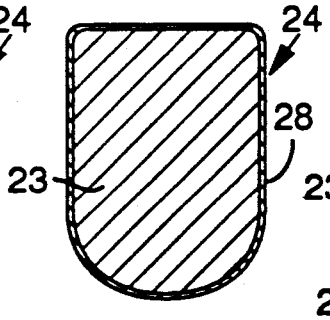
Figure 2C:
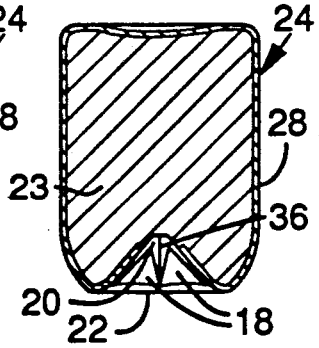

With reference now to FIGS. 2B and 5, the entire core 24 is electroplated with a plating material such as second metal 28 to provide a jacket. Metal 28 is preferably copper. The electroplating may be by a barrel or tumbling plant operation. The barrel plating method for applying such a jacket is known and provides excellent adhesion between the core 24 and plating material 28. It can also be controlled to produce a desired thickness and density of plating material.

Figure 3A:
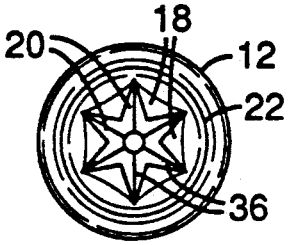
FIGS. 3A–B are top views of the bullet in the last two steps of manufacture.

In the next step (FIGS. 2C and 5), a partially electroplated cavity is formed within the rounded end 26 with slits through the plating material 28 along the cavity walls. The cavity may be formed in a number of ways, but the preferred swaging method is to use a punch and die, as illustrated in FIG. 4A. The electroplated core 24 is shown therein being driven by a rod 30 through a cylindrical die 32 against a hexagonal-edged, hollow point tapered punch 34. The tip of punch 34 presses into the end 26, forming an initial cavity while pressing the plating metal 28 into the cavity and splitting apart the metal 28 within the cavity to define the slits 20. To promote the desired mushrooming of the deformable metal 23, the tip of punch 34 is pressed sufficiently into the core to also define slits 36 within the lead below the slits 20. FIG. 3A is a top view of the bullet after this manufacturing step. It shows the plating metal 28 split into triangular segments 18 within the cavity. The slits 20 are visible between the segments, with narrower slits or creases 36 also cut into the deformable metal 23 Below the plating metal 28.

Figure 2D:
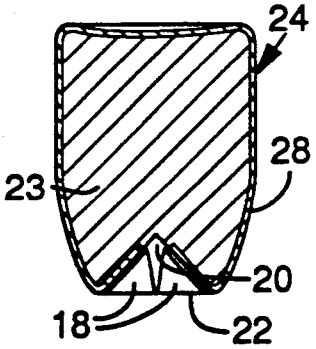
Figure 3B:
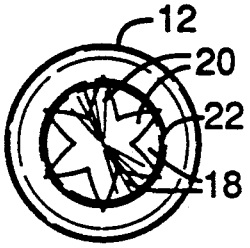

The final manufacturing step is illustrated in FIGS. 2D and 5. In this step the electroplated core 24 is reformed both externally and within the cavity to the desired final bullet shape. Internally, the cavity walls are inclined outward to a desired angle relative to the core's longitudinal axis while externally the end 26 is formed into the nose 14. FIG. 4B illustrates how the swaging may be performed with a punch and die. Rod 30 drives the core 24 through a second die 38 whose interior walls taper to form the ogive on the exterior of the nose of the bullet. In this step the core is simultaneously driven against the tip of a second punch 40 that presses the cavity walls outward, widens the slits 20 and extends the slits to just over the circumferential edge 22 of the cavity. The sharpness of creases 36 are blunted in the process. The shape of the tip of punch 40 and resulting shape of the final electroplated cavity may vary, depending on the type of bullet being manufactured. FIG. 2D illustrates the shape of the cavity for a .400 caliber bullet. FIG. 3B is a top view of the finished bullet, showing the expanded and extended slits 20.

The piercing of the core 24 with punch 34 creates internal creases in the lead 23 and work-hardens the second metal 28. The metal is further hardened by the subsequent reforming of the core 24 with punch 40 and die 38. The result is that the plating metal 28 is bonded to the core 24 both within the cavity and on the exterior of the nose 14 and is stiffened across the cavity's leading circumferential edge 22. Upon the bullet's impact against a target, the creases 36 in the metal 23 and the work-hardened segments 18 urge the core to mushroom along the creases 36 in a desired manner.

Figure 6:
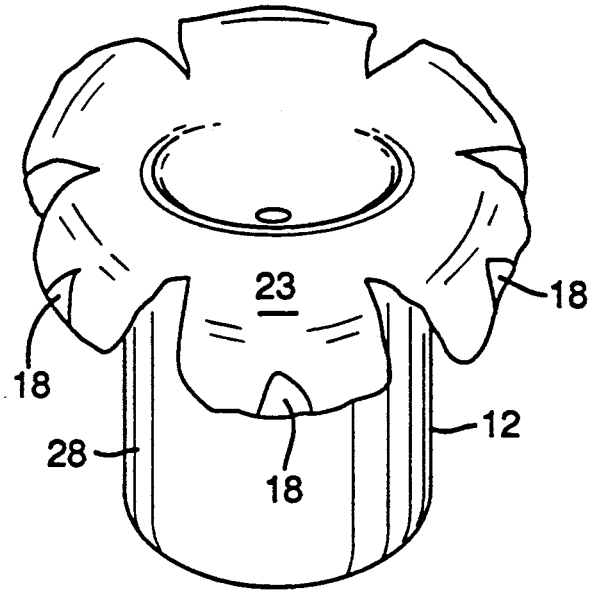
FIG. 6 is a perspective view of the bullet of FIG. 1 after impact against a target.

FIG. 6 is an illustration of a bullet manufactured according to the invention after the bullet's impact against a target. With the work-hardened plating metal 28 securely bonded on both sides of the nose 14 and yet split at the slit 20 to allow for expansion, the nose 14 mushrooms uniformly and predictably without fragmentation or overexpansion.

Having illustrated and described the priciples of the invention in a preferred embodiment, it should be apparent to those skilled in the art that the invention can be modified in arrangement and detail without departing from such principles. We claim all modifications coming within the spirit and scope of the following claims.

We claim:

1. A method of manufacturing a hollow point bullet, comprising the following steps:

providing a quantity of a deformable first metal for a bullet core;

electroplating the core with a second metal;

forming and electroplated cavity, the cavity having an edge, a bottom and walls between the edge and bottom within one end of the core; and splitting the second metal apart along the cavity walls thereby defining slits through the second metal between the cavity edge and cavity bottom.

2. The method of claim 1 wherein the steps of forming a cavity and splitting apart the second metal comprise pressing a tapered tip into the one end of the electroplated core.

3. The method of claim 1 wherein the step of splitting apart the second metal further comprises defining slits within the first metal below the slits through the second metal.

4. The method of claim 1 wherein the electroplated core has a longitudinal axis, the method including inclining the walls of the cavity to a desired angle relative to the axis of the electroplated core.

5. The method of claim 4 including simultaneously forming an ogive of the bullet on the exterior of the one end of the core.

6. The method of claim 1 wherein providing a quantity of a deformable first metal for a bullet core comprises providing a cylindrical core having one end that is rounded.

7. A method of manufacturing a hollow point bullet, comprising the following steps:

providing a quantity of a deformable first metal for a bullet core;

electroplating the core with a second metal;

forming a electroplated cavity, the cavity having an edge, a bottom and walls between the edge and bottom in one end of the core;

splitting apart the second metal within the cavity thereby defining slits through the second metal along the cavity walls between the cavity edge and cavity bottom; and defining slits within the first metal below the slits through the second metal.

8. The method of claim 7 wherein forming an electroplated cavity comprises pressing a multiple-edged hollow point tapered tip into the one end of the core.

9. The method of claims 7 including forming an ogive of the bullet on the exterior of the one end of the core simultaneously with inclining the cavity walls.

10. The method of claim 9 wherein inclining the cavity walls while simultaneously forming the ogive comprises placing the core in a tapered die and pressing the core against a tapered tip.

* * * * *

UNITED STATES PATENT AND TRADEMARK OFFICE

CERTIFICATE OF CORRECTION

PATENT NO. : 5,079,814

DATED : January 14, 1992

INVENTOR(S) : Steven R. Moore, et al.

It is certified that error appears in the above-identified patent and that said Letters Patent is hereby corrected as shown below:

In the Claims:

Column 4, line 50, "a electroplated" should be --an electroplated--.

Signed and Sealed this

First Day of June, 1993

Attest:

Michael K. Kirk

MICHAEL K. KIRK

Attesting Officer

Acting Commissioner of Patents and Trademarks